United States Patent [19]

Bischofberger et al.

[11] Patent Number: 4,730,720

[45] Date of Patent: Mar. 15, 1988

[54] DEVICE FOR TRANSPORTING CANS

[75] Inventors: Jürg Bischofberger, Elsau; Manfred Feige, Frauenfeld, both of Switzerland

[73] Assignee: Rieter Machine Works, Ltd., Winterthur, Switzerland

[21] Appl. No.: 904,345

[22] Filed: Sep. 5, 1986

Related U.S. Application Data

[62] Division of Ser. No. 616,403, Jun. 1, 1984.

[30] Foreign Application Priority Data

Jun. 8, 1983 [CH] Switzerland ..... 3133/83

[51] Int. Cl.[4] ..... B65G 25/02

[52] U.S. Cl. ..... 198/457; 198/614; 198/774; 198/775; 198/776

[58] Field of Search ..... 198/776, 457, 469, 470, 198/614, 772–775, 777

[56] References Cited

U.S. PATENT DOCUMENTS

| | | | |
|---|---|---|---|
| 666,865 | 1/1901 | Helfensteller, Jr. | 198/776 |
| 2,957,573 | 10/1960 | Eyster | 198/776 |
| 3,871,534 | 3/1975 | Bursk | 198/776 X |
| 4,155,443 | 5/1979 | Schuricht | 198/774 |

FOREIGN PATENT DOCUMENTS

| | | | |
|---|---|---|---|
| 2217462 | 10/1973 | Fed. Rep. of Germany | 198/774 |

*Primary Examiner*—Robert J. Spar
*Assistant Examiner*—Lyle K. Kimms
*Attorney, Agent, or Firm*—Kenyon & Kenyon

[57] ABSTRACT

The device for transporting fiber sliver cans employs pairs of rails for supporting a can during travel in a non-linear path. The pairs of rails are moved relative to each other in an endless path so that a can is supported on only one pair of rails during the forward movement of that pair of rails. No floor plate is required to support the cans. The straight rails of each set are interconnected by curved rails of an intermediate set of rails.

4 Claims, 13 Drawing Figures

Figure 1:
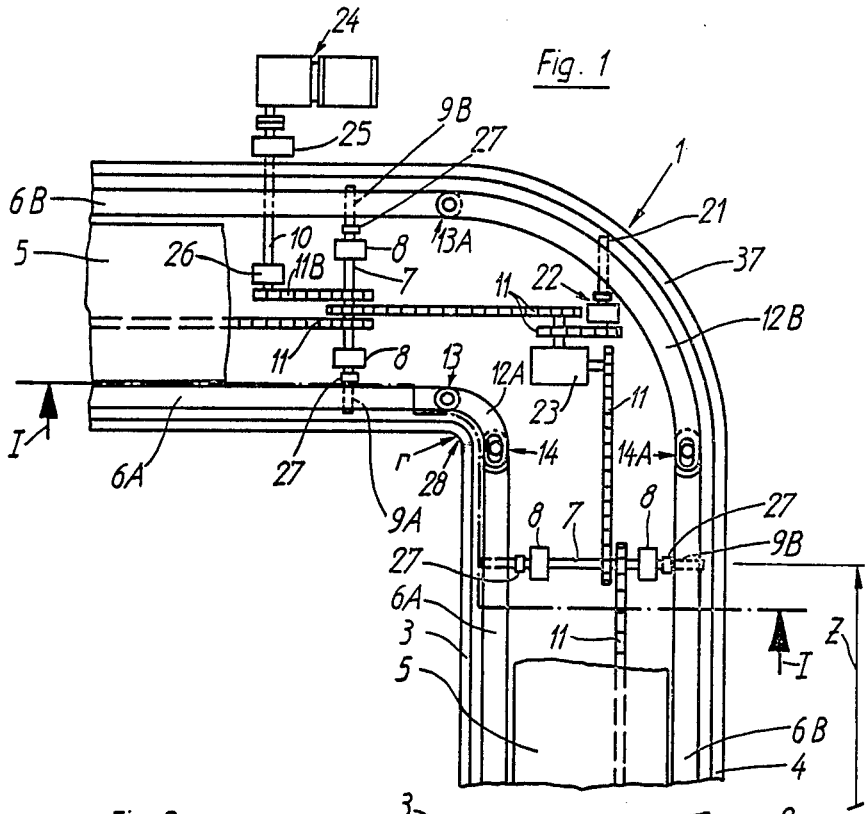

24
25
9B
27
1
21
37
12B
6B
5
26
10
11B
8
7
13A
11
22
11
8
13
12A
23
11
I
6A
27
r
28
14
14A
9A
8
7
8
27
9B
27
6A
3
5
11
Z
I
6B
4

3
2
5
h
6A
5
4
6B
R
35
9A
27
9A
27
8
7
8
27
9B 2A
29A
36
29B
H
5
35
6A; 12A
6B; 12B

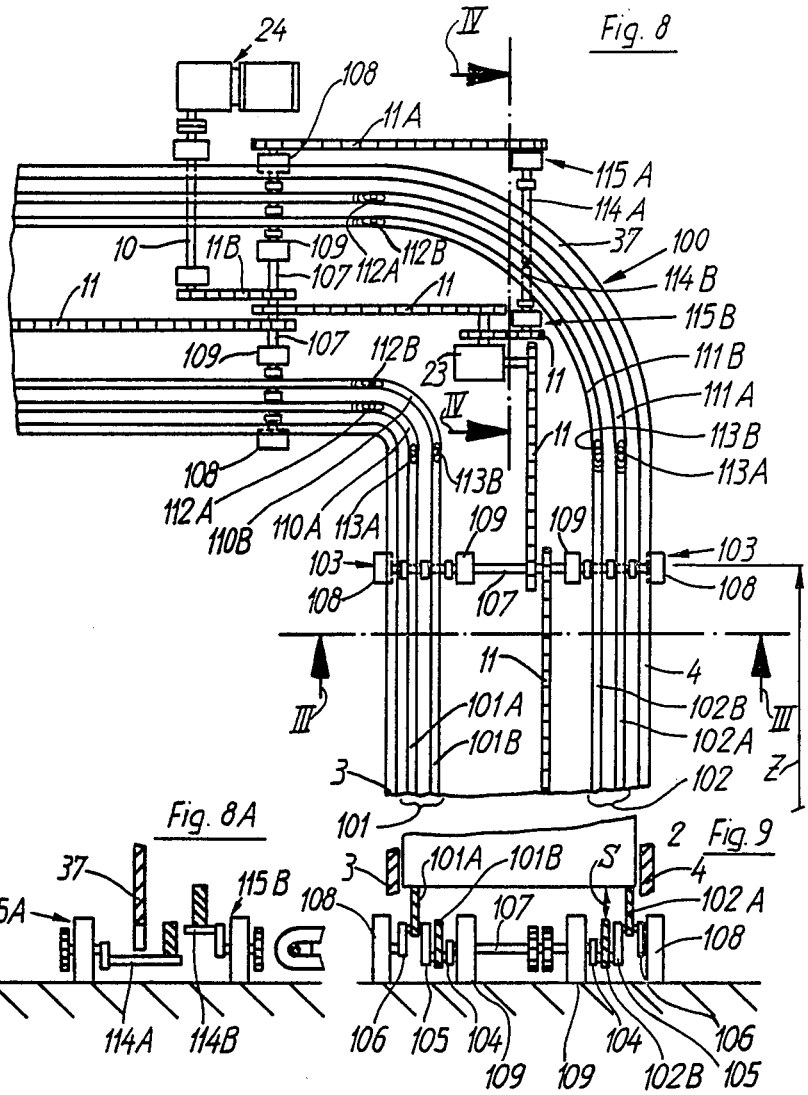
Fig. 8
24
IV
108
11A
115 A
114 A
37
100
114 B
115 B
111 B
111 A
113 B
113A
10
11B
109
107
112A
112B
11
23
IV
113B
108
112 A
110B
110A
113A
109
109
103
103
108
108
107
11
4
101A
101B
102B
102A
III
III
3
101
102
Z
Fig. 8A
37
115 B
115A
114A
114B
Fig. 9
2
3
101A
101B
S
4
108
107
102 A
108
106
105
104
109
109
104
102B
106
105
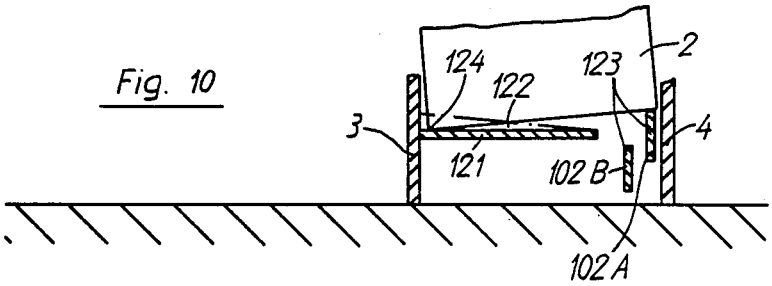
Fig. 10
124
122
123
2
3
4
121
102 B
102 A Fig. 11
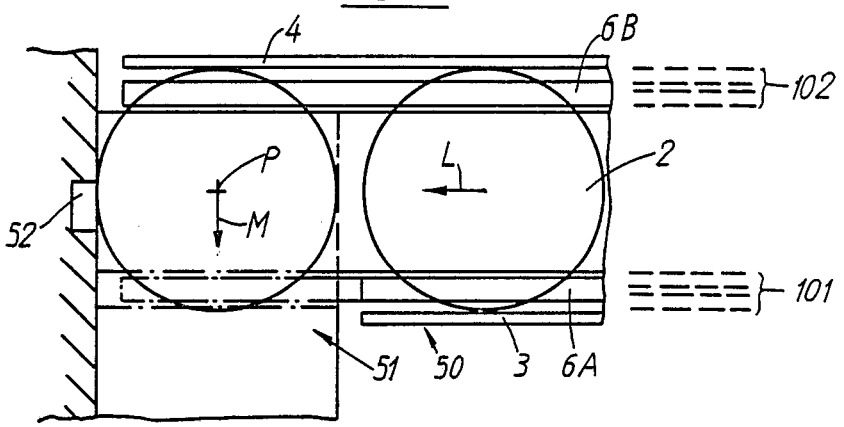
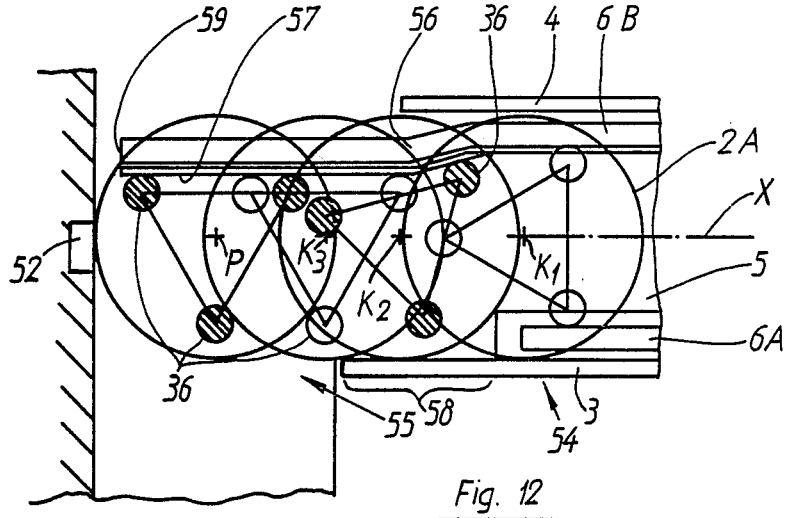
Fig. 12

DEVICE FOR TRANSPORTING CANS

This is a division of application Ser. No. 616,403 filed June 1, 1984.

The invention relates to a device for transporting cans with a horizontal can guiding system and a vertical can guiding system together with means for step-wise can feed.

Various devices have been known for transporting cans for example as described in Swiss Patent Specification No. 389 461 (corresponding to British Patent Specification No. 941 219 and U.S. Pat. No. 3,125,782). In this device, rods provided with fingers also have Mängelracks meshed wtih pinions. The fingers are secured to the rods with a spacing which is equal to the spacing of the centers of two successive cans. The rods travel through a distance which is equal to the center spacing of two cans.

The rods, and thus the fingers, are lifted during movement. Thus, the fingers move underneath the floor of the can towards the internal surface of the base of the can, so as to grasp the can forcibly and move it through the set distance. This forward stroke is terminated by the lowering and withdrawal of the fingers.

The disadvantages of this device are that only a straight transport movement is possible and that the forcible transport can lead to damage in the event of faults. Furthermore, the whole shifting mechanism is relatively expensive.

Accordingly, it is an object of the invention to provide a simple device for transporting fiber sliver cans.

It is another object of the invention to be able to transport fiber sliver cans in a damage-free manner.

It is another object of the invention to provide a relatively inexpensive device for transporting fiber sliver cans.

Briefly, the invention provides a device for transporting fiber sliver cans which is comprised of a vertical can guide system having a pair of vertical boards for guiding a can horizontally in a non-linear guide path as well as a can feed means for moving the can in a step-wise manner between and along the boards. The can feed means includes two sets of parallel transport rails which are disposed in angular relation to each other and a set of curved rails which interconnect the set of parallel rails. In addition, each set of rails includes two pairs of horizontally spaced rails. Still further, the can feed means has means for moving the rails through an endless path relative to the guide path with a can supported on one of said pairs of rails of a respective set during a forward movement of rails.

With this construction, the cans are supported solely by the rails during transport without need for a floor or stationary plate under the cans.

Furthermore the device can be advantageously used as a can magazine and as an empty can station forming part of a can magazine and a can changing device.

The advantages produced by the device are to be seen substantially in that the cans are transported in the simplest manner and such that a position correction can be carried out at any time, and further in that the transport system is usable for nonlinear transport directions. Furthermore, the same device can transport in both directions simply by changing the direction of rotation of a drive motor.

In the following, the invention is explained in further detail with the aid of drawings representing merely exemplary embodiments.

Figure 2:
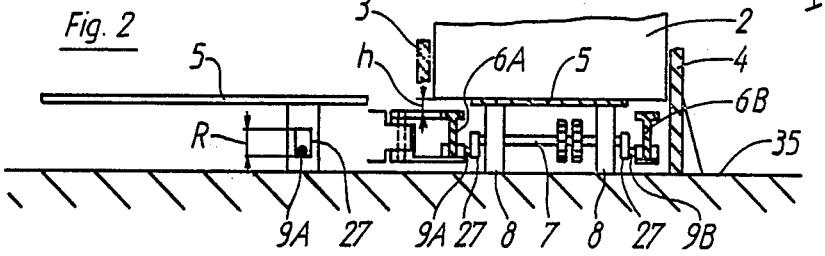
Figure 3:
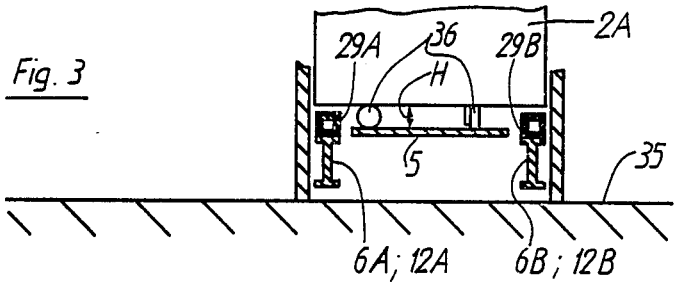
Figure 6:
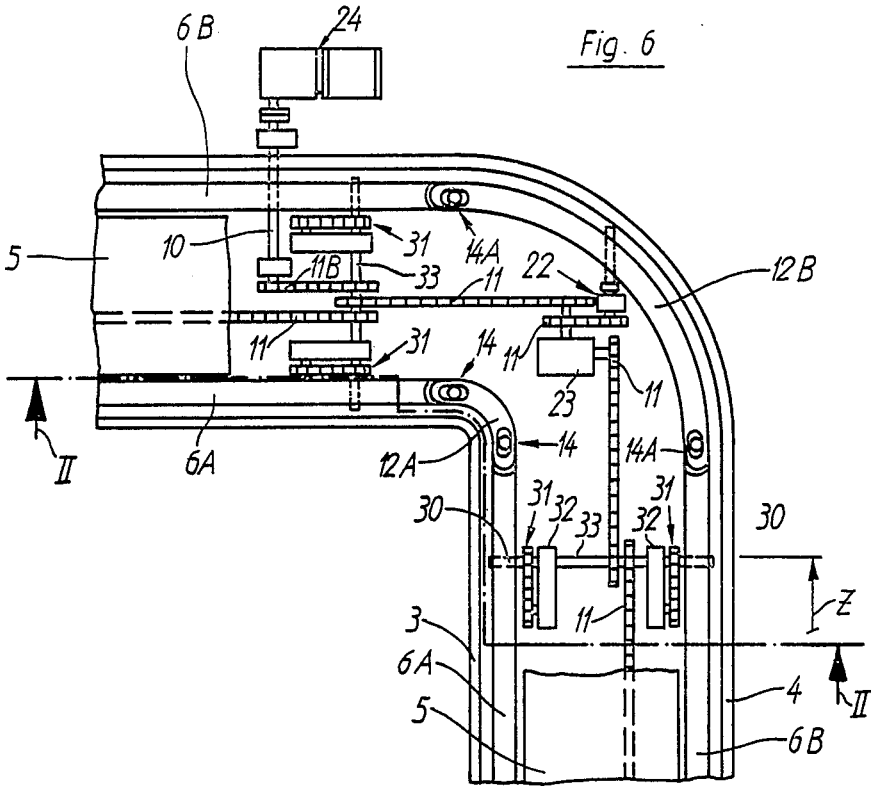
Figure 7:
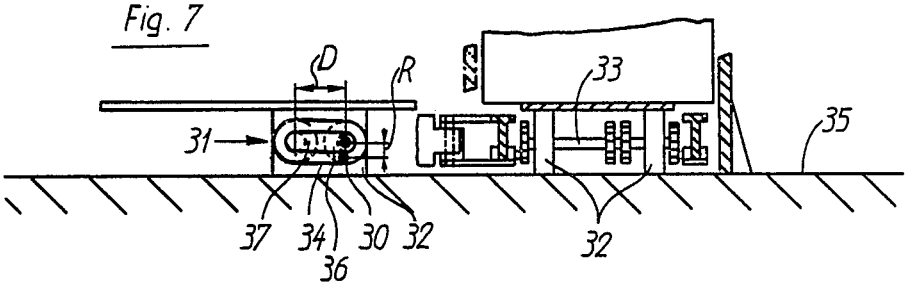
Figure 4:
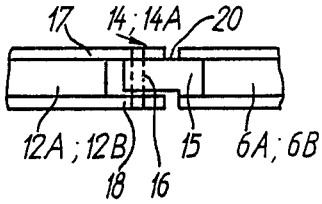
Figure 5:
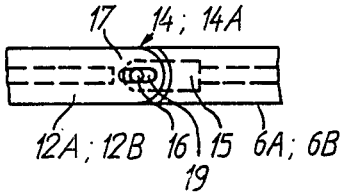

FIG. 1 shows a ground plan of a device according to the invention, partly open and illustrated part-schematically, FIG. 2 shows a section of the device according to FIG. 1 taken on the section line I—I, FIG. 3 shows a modification of the device according to FIG. 1 illustrated in section and part-schematically, FIG. 4 shows an elevation of a detail of the device according to FIG. 1 enlarged and illustrated part-schematically, FIG. 5 shows a plan view of the detail of FIG. 4, FIG. 6 shows a modification of the device of FIG. 1, FIG. 7 shows a cross seciton of the device of FIG. 6 taken on the section line II—II, FIG. 8 shows a plan view of a further device according to the invention, partly open and illustrated part-schematically, FIG. 8A shows a cross section through a detail of the device of FIG. 8 taken on the section line IV—IV, FIG. 9 shows a section of the device of FIG. 8 taken on the section line III—III, FIG. 10 shows a modification of the device of FIG. 8 illustrated in section and part-schematically, FIG. 11 illustrates a plane view of a transport device embodied in a can magazine and empty can station arrangement in accordance with the invention; and FIG. 12 illustrates a view similar to FIG. 11 for cans having rollers on the underside.

A device 1 for transporting cans 2 (FIG. 2) comprises a vertical can guide system in the form of side guide boards 3 and 4, a horizontal guide system in the form of a floor plate 5 arranged between the guide boards, and a can feed.

The can feed for its part comprises two pairs of transport rails 6A and 6B and for each pair of transporting rails two crankshafts 7 carrying the rails 6A and 6B (in FIG. 1 only one crankshaft per transporting rail pair is shown). Each crankshaft 7 is rotatably supported by means of two stationary bearing members 8. The rails 6A and 6B are supported from the crankshafts 7 by means of the cranklevers 27 provided at the ends of each crankshaft 7 or by the crankpins 9A 9B respectively secured thereto. The crankpins 9A and 9B have the same disposition relative to the crankshaft axis, that is they are arranged in alignment.

Drive transmission from one driveshaft 10 to the adjacent crankshaft 7, and from a crankshaft 7 to the adjacent crankshaft 7, is produced by drive chains 11 or the associated chain wheels seated on the corresponding shafts (not directly visible).

In dependence on the transport distance, or depending upon whether the transport direction is non-linear as shown in FIG. 1, two or more transport rails (as shown in FIG. 1), are coupled directly or indirectly together by means of curved rails. If, as shown in FIG. 1, the transport direction has an elbow, then the transport rails 6A and 6B are adjustably connected together by means of curved rails 12A and 12B at the joint locations 13 and 14 or 13A and 14A. One of the two joint locations, for example the joint location 14 or 14A, is a so called adjustable joint, which comprises on the one hand a strap 15 secured to one of the transporting rails 6A or 6B with a pin 16 fixedly secured therein, and on the other hand guide slots 19 (only one of which is visible) formed in tongues 17 and 18 provided on the curved rails 12A, 12B respectively for receiving the pin 16. The pin 16 is slidably guided in the guide slots and thereby forms the horizontal guidance at this joint location 14 or 14A. The vertical guidance at this joint location is formed in that the underside of tongue 17 rests slidably on the upper surface 20 of the strap 15.

The adjustable joint is necessary to compensate the change in the distance between the bolts 16 i.e. the parallel rails 6A, 6B and curved rails 12A, 12B which arises as a result of the differing directions of movement during the movement of the joint locations.

Further, in order to form the outer curved rail, in FIG. 1 the curved rail 12B, lighter in terms of strength, it can rest with its under side (not shown) on a crank pin 21 of a crank drive 22. This crank drive is driven, as in an arrangement shown in FIG. 1, by means of a chain 11 from bevel gear drive 23 used for this arrangement.

A geared motor 24 serves as the common drive for all crankshafts together with the bevel drive mentioned above. The motor is drivingly connected by way of driveshaft 10 supported in bearings 25, 26 and by way of a chain 11 with the adjacent crankshaft 7.

Furthermore, in an arrangement as illustrated in FIG. 1, the guideboards 3, 4 respectively must have appropriate bends 28, 37 respectively in the elbow portion.

Advantageously, the radius r of the inner bend 28 is made greater than necessary to correspond to proportions adapted to the elbow portion so as to increase the play for the cans in the elbow portion.

The section illustrated in FIG. 2 shows an embodiment for cans 2 without rollers, while in FIG. 3 an arrangement is shown for cans 2A with rollers 36. In this latter arrangement, the rails 6A and 6B and the curved rails 12A, 12B are provided with a support portion 29A, 29B respectively which is correspondingly bent for the curved rails 12A, 12B and which has a height corresponding to the height H of the rollers. Furthermore, for the arrangement according to FIG. 3 the guideboards 3 and 4 are also raised through this height H. The height H corresponds to the spacing between the can floor and the floor plate 5. Furthermore, the spacing h (FIG. 2) between the rails 6A and 6B and the floor of the can 2 should not be greater than the crankradius R, which corresponds to half of the stroke height of the rail. The crankradius R is the spacing between the longitudinal axis of the crankpins 9A, 9B and the longitudinal axis of the crankshaft 7. The crankpin is a part of the cranklever 27 which is fixedly connected to the crankshaft 7.

In the modification illustrated in FIGS. 6 and 7 the rails 6A, 6B are carried by crankpins 30 which form respective portions of a chaindrive 31. The chaindrive 31 further comprises a bearing housing 32 for receiving a shaft end, fitted with a chainwheel 36, of a driveshaft 33 and an axle (not shown) provided with a further chainwheel 37.

The two chainwheels 36 and 37 serve to receive a support chain 34 which for its part is a carrier for the crankpin 30. Both chainwheels 36, 37 have the same spacing from the base surface 35.

In the embodiment illustrated in FIGS. 6 and 7, chaindrives 31 are provided respectively at both ends of the driveshafts 33. Further, the rails 6A, 6B are each carried by two crankpins 30, that is two chaindrives are required per rail 6A, 6B.

The other elements of the modifications correspond to the embodiments illustrated and described with reference to FIGS. 1 to 3 and therefore have the same reference numerals. Further, in these embodiments, the transport distance of the cans is greater by the spacing D of the rotation axes (not shown) of the chainwheels 36 and 37 than in the embodiment according to FIGS. 1 and 2, which corresponds at the maximum to the rotation diameter of the crankpin longitudinal axis. Furthermore, two adjustable joints 14, 14A respectively are provided per curved rail 12A, 12B respectively.

FIGS. 2, 3 and 7 each show the transport rails 6A and 6B in the starting position beneath the floorplate 5 which functions as the horizontal guiding system for the cans 2 and 2A.

A further device 100 for transporting of cans 2 is illustrated in the FIGS. 8 to 10 and comprises, in contrast to the above-described devices, a canfeed with a pair of rails 101 with the individual rails 101A and 101B, and with a second rail pair 102 parallel thereto with the individual rails 102A and 102B, and for each rail pair 101, 102 two doublestroke crankdrives 103 (only one per rail pair being visible). However, elements which have already been described and which have been used again for this modification have the same reference numerals.

The crankdrives comprise an inner cranklever 104, a middle cranklever 105 and an outer cranklever 106 and a crankpin (not directly visible) joining these together and supporting the rails.

Further, the inner cranklever 104 is connected to a driveshaft 107 and the outer cranklever 106 is rotatably supported by means of a further crankpin in a bearing member 108. The driveshaft is also rotatably supported in the bearing members 109.

The rails 101A, 101B and 102A, 102B are provided with bearing sleeves (not shown) for receiving the crankpins.

The rails 101A, 102A are arranged between the outer cranklever 106 and the middle cranklever 105, and the rails 101B, 102B are arranged between the middle cranklever 105 and the inner cranklever 104.

Depending upon whether the transporting distance is linear or non-linear two or more transport rail pairs are coupled together directly or, as shown in FIG. 8, by means of curved rails 110A, 110B and 111A, 111B indirectly.

The straight rails are connected by means of joint locations 112A, 112B and joint locations 113A, 113B with the above mentioned curved rails.

For each curved rail at least one joint position is provided of the adjustable joint type already described for the modifications according to FIGS. 1 to 7.

Further, as shown in FIGS. 8 and 8A, the outer curved rails 111A, 111B can be supported at their undersides (not shown) on a crankpin 114A, 114B of a crankdrive 115A, 115B respectively. The crankdrive 115B is driven in an arrangement as shown in FIG. 8 by means of a transmission chain 11 from the beveldrive 23 used for such an arrangement, while the crankdrive 115A is driven via a chain 11A including the associated chainwheels (not shown) from an extended shaft end of a drive shaft 107.

The beveldrive 23 and also the driveshaft 107 are driven by means of additional transmission chains 11. The transmission chains differ from one another substantially only in the necessarily different, appropriate length.

The chainwheels required for the transmission chains and driving the beveldrive and crankdrives have the same pitch circle diameter in all illustrated and described embodiments.

The driveshaft 10 driven from gearmotor 24 drives the adjacent driveshaft 107 by means of a transmission chain 11 and the associated chainwheels. In order to change the rotational speed of shafts 107, the chainwheels of the chain 11B can have correspondingly different numbers of teeth or pitch circle diameters. This applies also for the embodiments illustrated in FIGS. 1 and 6.

The guideboards 3 and 4 already described in connection with the FIGS. 1 to 3, and the associated bends, are used, with appropriate modifications, also for these variants. The modification consists solely in that a space for the respective outer bearing members 108 for the crankshaft **114*a*** is formed in the guideboards.

In operation, the rails 101A, 102A and the rails 101B, 102B alternately take up the cans 2 and transport them along the guideboards 3, 4 with a stroke corresponding to half of a stroke height S (FIG. 9). A floor 5 is not required for these variants, that is the rails perform alternately the function of the horizontal can guidance.

The transport direction of the cans can be chosen corresponding to the direction of the rotation of the gearmotor 24.

The stroke height S corresponds to the double crankradius, which for its part corresponds to the spacing between the rotation axis of the driveshaft 107 and the rotation axis of the crankpins.

Further, FIG. 10 shows a simplified embodiment of the variants illustrated in FIGS. 8 and 9, in that only the rail pair 102 is used for the feed of the cans 2 and the rail pair 101 is omitted. In place of the omitted rail pair 101, a floorplate i.e. guideplate 121 is required for supporting the cans 2. As a result of the provision of the transporting rail pair on one side only, the can 2 only rests fully on the floorplate 101 when the rails 102A and 102B take up the same height relative to floor 35. The surface 122 of the floorplate 121, and the upper rail surfaces 123 of the two transport rails 102A, 102B then lie in the same imaginary plane.

In operation, the can 2 is lifted alternately by the rails 102A, 102B respectively and is rolled by the forward movement by these rails along the guideboards 3 on the floor edge 124 of the can 2. This form of movement produces one-sided swinging deviations of the can 2 which are changed by inclined portions of the floorplate 121 (as indicated with a dotted line 125) into double-sided rocking movements each at most only half as large. The inclined portions should be optimized in such manner that the can 2 when resting on the floorplate 121 rests simultaneously on the rails 102A when the rails 102A and 102B have reached the same height.

In all illustrated variants, for each straight rail or for each straight rail pair, two crankdrives are required arranged with a spacing Z from each other. The spacing Z is shorter than the spacing between two joint positions.

FIG. 11 shows the use of the device according to the arrangements illustrated in FIGS. 1 and 2, 6 and 7 and 8 to 10 as a can magazine 50 with an empty can station 51.

The can 2 in can magazine 50 is transported in the direction indicated by the arrow L into the empty can position P. From this position P, the can is removed in the direction of the arrow M by means not related to the invention, for example a removal arm (not shown) grasping the can 2.

According to the arrangements illustrated in FIGS. 1 and 2 or 6 and 7, transport of the can 2 takes place in the can magazine 50 by means of the rails 6A and 6B, while in the region of the empty can magazine 51 the can 2, in the manner shown with full lines, is transported only by the rail 6B substantially in the direction L for a distance such that the can 2 operates an electrical proximity switch 52 which causes interruption of the rail movement.

After the can 2 has been removed in the direction of the arrow M transport in the direction of arrow L starts again.

As a variant to the one-sided transport of the can 2 in the region of the empty can magazine 51 by means of the rail 6B, transport can occur, as indicated by dotted lines, with the rails 6A and 6B provided that an additional switch element (not shown) signaling the same height of the rails is combined with the proximity switch 52 in such manner that after operation of this proximity switch 52 the rails are stopped only when the same height of the rails 6A and 6B is reached. At this height, the rails are below the floorplate 5 (see FIG. 2) so that the can 2 can be removed in the direction M.

If on the other hand the rail pairs 101 and 102 shown in FIGS. 8 and 9 are used ( indicated in FIG. 11 with dotted lines) then a floorplate (not especially shown) is provided only in the region of the empty can station 51.

This floorplate substantially covers the width of the empty can magazine, that is it extends, as viewed from point P in the direction of the can magazine 50, up to a boundary of the empty can magazine 51 indicated with a dotted line. This floorplate is arranged a few millimeters higher than the rails of the rail pairs 101 and 102 which are located at the same height.

In operation, during transport into the empty can station, the rails of the rail pairs 101 and 102 alternately lift the can 2 on the floorplate and towards the proximity switch 52.

A switch element (not shown) signaling the height of the rails is combined with the proximity switch 52 in such manner that upon operation of the proximity switch the rails stop only when they are located at the same height.

If on the other hand the variant illustrated in FIG. 10 is used, then the empty can station 51 and the can magazine 50 have the same form except that the guideboards 3 do not extend into the region of the empty can station, which applies for all previously described empty can stations of the illustrated type as also those to be described in the following.

Finally, FIG. 12 shows the use of the variant illustrated in FIG. 3 with a can magazine 54 and an empty can station 55.

In contrast to the embodiments illustrated in FIGS. 1 and 6, the can magazine 54 has at the end portion 58 bordering on the empty can station 55 the additional feature that the rail 6B has a bend 56 towards the longitudinal axis X of the magazine in order to extend further under the cans 2A provided with rollers 36 (indicated in FIG. 12 by circles).

A guideplate 57 provided, as viewed in the direction of the longitudinal axis X in front of this bend and extending to the end 59 of the rail 6B, acting in combination with the guideboard 3 guiding the can 2A and lying opposite the guideplate 57, forces the rollers 36 to adopt a position in which two of the three rollers 36 engage substantially on the guideplate 57 in order to be forwarded in this position onto the empty can position P.

Thus, the rollers 36 cannot come into contact with the rail 6B even in that region in which no further guideboards 3 and 4 are provided.

Further, in order also to avoid bringing the rollers 36 into collision with the rail 6A, the rail 6A ends substantially in the region opposite the bend 56.

In FIG. 12, four successive can positions are shown, namely position K1 in which the can 24 is still located in the can magazine 54, position X2 in which one of the rollers 36 is located against the guideplate 57 in the region of the bend 56, position K3 in which two of the rollers 36 engage the guideplate 57 and finally the position P. In order to better indicate the roller positions, they are shown hatched in positions K1 and P.

By means of the bend 56, the rollers 36, which are arranged on the can 2A as an equilateral triangle, are forced into a position in which the height of the equilateral triangle stands at right angles to the transport direction L.

This position of the rollers 36 gives the size of the maximal possible bend.

Further, the cans 2A are transported in this position of the rollers 36 into engagement with the proximity switch 52 also used for this variant in the empty can station 55. The rails 6A and 6B are immediately stopped in any height position by the proximity switch 52.

An earlier described combination of the proximity switch 52 with means signaling the height of the rails is also possible if the rails are to be brought to a stop in the region beneath the floorplate. The advantage of this variant is that the can 2A in the empty can station 55 rests with all the rollers 36 on the floorplate 5 after reaching the proximity switch 52.

In the region before the end portion 58, the cans 2A are transported through the can magazine 54 with an undefined roller position.

We claim:

1. A device for transporting fiber sliver cans comprising a vertical can guide system having a pair of vertical boards for guiding a can horizontally therebetween in a non-linear guide path; and a can feed means for moving the can in a stepwise manner between and along said boards, said can feed means including two sets of parallel transport rails disposed in angular relation to each other, a set of curved rails between said sets of parallel rails, adjustable joints connecting said parallel rails to said curved rails to compensate for changes in distance between said parallel rails and said curved rails, each set of rails including two pairs of horizontally spaced rails and means for moving said pairs of rails through an endless path relative to said guide path and moving one pair of rails relative to the other pair of rails with a can supported on either pair of rails having forward movement during forward movement of said rails.

2. A device as set forth in claim 1 wherein each pair of transport rails of a respective set is vertically spaced from the other pair of transport rails of said respective set during forward movement thereof.

3. A device as set forth in claim 2 wherein said pairs of transport rails of a respective set are movable into a common plane to support a can thereon simultaneously.

4. A device as set forth in claim 2 wherein said means includes two doublestroke crankdrives for moving said rails of each respective set relative to each other.

* * * * *